US009650978B2

(12) United States Patent
Phillips

(10) Patent No.: US 9,650,978 B2
(45) Date of Patent: May 16, 2017

(54) SYSTEM AND METHOD FOR RANDOMLY ADJUSTING A FIRING FREQUENCY OF AN ENGINE TO REDUCE VIBRATION WHEN CYLINDERS OF THE ENGINE ARE DEACTIVATED

(71) Applicant: GM Global Technology Operations LLC, Detroit, MI (US)

(72) Inventor: Andrew W. Phillips, Rochester, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 706 days.

(21) Appl. No.: 13/798,775

(22) Filed: Mar. 13, 2013

(65) Prior Publication Data

US 2014/0190449 A1 Jul. 10, 2014

Related U.S. Application Data

(60) Provisional application No. 61/749,510, filed on Jan. 7, 2013.

(51) Int. Cl.
*F02P 5/00* (2006.01)
*F02D 41/00* (2006.01)
*F02D 37/02* (2006.01)

(52) U.S. Cl.
CPC ..... *F02D 41/0087* (2013.01); *F02D 37/02* (2013.01)

(58) Field of Classification Search
CPC ..... Y02T 10/46; Y02T 10/7275; F02D 17/02; F02D 41/0087; F02D 37/02; F02D 13/06; F02D 2250/21; F02D 41/1401; F02D 41/1402; F02P 5/1512; F01N 2430/08; B60L 2240/423; B60L 2240/443; B60W 10/06; Y10S 903/905
USPC ..... 123/406.12, 406.2, 406.19, 406.11, 123/406.18, 406.33, 322, 339.11, 406.59,
(Continued)

(56) References Cited

U.S. PATENT DOCUMENTS 3,596,640 A 8/1971 Bloomfield
4,129,034 A 12/1978 Niles et al.
4,172,434 A 10/1979 Coles
(Continued)

FOREIGN PATENT DOCUMENTS

CN 1573916 A 2/2005
CN 1888407 A 1/2007
(Continued)

OTHER PUBLICATIONS

U.S. Appl. No. 13/798,351, Rayl, filed Mar. 13, 2013.
U.S. Appl. No. 13/798,384, Burtch, filed Mar. 13, 2013.
U.S. Appl. No. 13/798,400, Phillips, filed Mar. 13, 2013.
U.S. Appl. No. 13/798,435, Matthews, filed Mar. 13, 2013.
U.S. Appl. No. 13/798,451, Rayl, filed Mar. 13, 2013.
U.S. Appl. No. 13/798,471, Matthews et al., filed Mar. 13, 2013.
(Continued)

*Primary Examiner* — Hung Q Nguyen
*Assistant Examiner* — John Bailey

(57) ABSTRACT

A system according to the principles of the present invention includes a firing fraction module, an offset generation module, and a firing fraction module. The firing fraction module determines a firing fraction based on a driver torque request. The offset generation module randomly generates an offset. The firing control module adds the firing fraction to a running total each time that a crankshaft of an engine rotates through a predetermined angle, adds the offset to the running total, and executes a firing event in a cylinder of the engine when the running total is greater than or equal to a predetermined value.

20 Claims, 3 Drawing Sheets

(58) Field of Classification Search
USPC ..... 123/406.6, 406.66, 90.15, 198 F, 692; 60/285; 701/105; 903/905
See application file for complete search history.

(56) References Cited

U.S. PATENT DOCUMENTS 4,377,997 A 3/1983 Staerzl
4,434,767 A 3/1984 Kohama et al.
4,489,695 A 12/1984 Kohama et al.
4,509,488 A 4/1985 Forster et al.
4,535,744 A 8/1985 Matsumura
4,770,148 A 9/1988 Hibino et al.
4,887,216 A 12/1989 Ohnari et al.
4,974,563 A 12/1990 Ikeda et al.
4,987,888 A 1/1991 Funabashi et al.
5,042,444 A 8/1991 Hayes et al.
5,094,213 A * 3/1992 Dudek ..... F02D 37/00 123/339.27
5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A 1/1995 Schechter
5,423,208 A * 6/1995 Dudek ..... F02D 41/045 123/478
5,465,617 A * 11/1995 Dudek ..... F02D 41/18 73/1.34
5,496,227 A 3/1996 Minowa et al.
5,540,633 A 7/1996 Yamanaka et al.
5,553,575 A 9/1996 Beck et al.
5,584,266 A 12/1996 Motose et al.
5,669,354 A * 9/1997 Morris ..... F02D 41/1498 123/406.24
5,692,471 A 12/1997 Zhang
5,720,257 A 2/1998 Motose et al.
5,778,858 A 7/1998 Garabedian
5,813,383 A 9/1998 Cummings
5,884,605 A 3/1999 Nagaishi et al.
5,909,720 A * 6/1999 Yamaoka ..... B60K 6/365 123/179.3
5,931,140 A 8/1999 Maloney
5,934,263 A 8/1999 Russ et al.
5,941,927 A 8/1999 Pfitz
5,974,870 A 11/1999 Treinies et al.
5,975,052 A 11/1999 Moyer
5,983,867 A 11/1999 Stuber et al.
6,125,812 A 10/2000 Garabedian
6,158,411 A 12/2000 Morikawa
6,244,242 B1 6/2001 Grizzle et al.
6,247,449 B1 6/2001 Persson
6,272,427 B1 8/2001 Wild et al.
6,286,366 B1 9/2001 Chen et al.
6,295,500 B1 9/2001 Cullen et al.
6,332,446 B1 12/2001 Matsumoto et al.
6,334,425 B1 1/2002 Nagatani et al.
6,355,986 B1 3/2002 Kato et al.
6,360,724 B1 3/2002 Suhre et al.
6,363,316 B1 3/2002 Soliman et al.
6,371,075 B2 4/2002 Koch
6,385,521 B1 5/2002 Ito
6,408,625 B1 6/2002 Woon et al.
6,520,140 B2 2/2003 Dreymuller et al.
6,546,912 B2 4/2003 Tuken
6,588,261 B1 7/2003 Wild et al.
6,619,258 B2 9/2003 McKay et al.
6,622,548 B1 9/2003 Hernandez
6,694,806 B2 2/2004 Kumagai et al.
6,738,707 B2 5/2004 Kotwicki et al.
6,754,577 B2 6/2004 Gross et al.
6,760,656 B2 7/2004 Matthews et al.
6,850,831 B2 2/2005 Buckland et al.
6,909,961 B2 6/2005 Wild et al.
6,978,204 B2 12/2005 Surnilla et al.
6,980,902 B2 12/2005 Nakazawa
6,981,492 B2 1/2006 Barba et al.
6,983,737 B2 1/2006 Gross et al.
7,003,390 B2 2/2006 Kaga
7,024,301 B1 4/2006 Kar et al.
7,025,041 B2 4/2006 Abe et al.
7,028,661 B1 4/2006 Bonne et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,066,136 B2 6/2006 Ogiso
7,069,718 B2 * 7/2006 Surnilla ..... F01N 13/011 123/198 F
7,069,773 B2 7/2006 Stempnik et al.
7,086,386 B2 8/2006 Doering
7,100,720 B2 9/2006 Ishikawa
7,111,612 B2 9/2006 Michelini et al.
7,140,355 B2 11/2006 Michelini et al.
7,159,568 B1 1/2007 Lewis et al.
7,174,713 B2 2/2007 Nitzke et al.
7,174,879 B1 * 2/2007 Chol ..... F02D 31/002 123/406.11
7,200,486 B2 4/2007 Tanaka et al.
7,203,588 B2 4/2007 Kaneko et al.
7,231,907 B2 6/2007 Bolander et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,367,318 B2 5/2008 Moriya et al.
7,415,345 B2 8/2008 Wild
7,440,838 B2 10/2008 Livshiz et al.
7,464,676 B2 12/2008 Wiggins et al.
7,472,014 B1 12/2008 Albertson et al.
7,497,074 B2 * 3/2009 Surnilla ..... F02D 41/0087 123/520
7,499,791 B2 3/2009 You et al.
7,503,312 B2 3/2009 Surnilla et al.
7,509,201 B2 3/2009 Bolander et al.
7,555,896 B2 7/2009 Lewis et al.
7,577,511 B1 * 8/2009 Tripathi ..... F02D 41/0087 701/103
7,581,531 B2 9/2009 Schulz
7,614,384 B2 11/2009 Livshiz et al.
7,620,188 B2 11/2009 Inoue et al.
7,621,262 B2 11/2009 Zubeck
7,634,349 B2 12/2009 Senft et al.
7,685,976 B2 * 3/2010 Marriott ..... F02D 13/0215 123/348
7,785,230 B2 8/2010 Gibson et al.
7,836,866 B2 11/2010 Luken et al.
7,849,835 B2 * 12/2010 Tripathi ..... F02D 41/0087 123/350
7,886,715 B2 2/2011 Tripathi et al.
7,930,087 B2 4/2011 Gibson et al.
7,946,263 B2 5/2011 O'Neill et al.
7,954,474 B2 6/2011 Tripathi et al.
8,050,841 B2 11/2011 Costin et al.
8,099,224 B2 * 1/2012 Tripathi ..... F02D 17/02 123/478
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 4/2012 Leone et al.
8,272,367 B2 * 9/2012 Shikama ..... F02D 11/105 123/406.24
8,347,856 B2 1/2013 Leone et al.
8,402,942 B2 3/2013 Tripathi et al.
8,473,179 B2 6/2013 Whitney et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.
8,706,383 B2 4/2014 Sauve et al.
8,833,058 B2 9/2014 Ervin et al.

(56) References Cited

U.S. PATENT DOCUMENTS 8,833,345 B2 9/2014 Pochner et al.
8,869,773 B2 10/2014 Tripathi et al.
8,979,708 B2 3/2015 Burtch
9,020,735 B2 4/2015 Tripathi et al.
9,140,622 B2 9/2015 Beikmann
9,200,575 B2 12/2015 Shost
9,212,610 B2 12/2015 Chen et al.
9,222,427 B2 12/2015 Matthews et al.
2001/0007964 A1 7/2001 Poljansek et al.
2002/0038654 A1 4/2002 Sasaki et al.
2002/0039950 A1 4/2002 Graf et al.
2002/0156568 A1 10/2002 Knott et al.
2002/0162540 A1 11/2002 Matthews et al.
2002/0189574 A1 12/2002 Kim
2003/0116130 A1 6/2003 Kisaka et al.
2003/0123467 A1 7/2003 Du et al.
2003/0131820 A1 7/2003 Mckay et al.
2003/0172900 A1 9/2003 Boyer et al.
2004/0007211 A1 1/2004 Kobayashi
2004/0034460 A1 2/2004 Folkerts et al.
2004/0069290 A1 4/2004 Bucktron et al.
2004/0122584 A1 6/2004 Muto et al.
2004/0129249 A1 7/2004 Kondo
2004/0138027 A1 7/2004 Rustige et al.
2004/0206072 A1 10/2004 Surnilla et al.
2004/0258251 A1 12/2004 Inoue et al.
2005/0016492 A1 1/2005 Matthews
2005/0056250 A1 3/2005 Stroh
2005/0098156 A1 5/2005 Ohtani
2005/0131618 A1 6/2005 Megli et al.
2005/0197761 A1* 9/2005 Bidner ..... F02P 5/045 701/105
2005/0199220 A1 9/2005 Ogiso
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2006/0112918 A1 6/2006 Persson
2006/0130814 A1 6/2006 Bolander et al.
2006/0178802 A1 8/2006 Bolander et al.
2007/0012040 A1 1/2007 Nitzke et al.
2007/0042861 A1 2/2007 Takaoka et al.
2007/0051351 A1 3/2007 Pallett et al.
2007/0100534 A1 5/2007 Katsumata
2007/0101969 A1 5/2007 Lay et al.
2007/0107692 A1 5/2007 Kuo et al.
2007/0131169 A1 6/2007 Ahn
2007/0131196 A1 6/2007 Gibson et al.
2007/0135988 A1 6/2007 Kidston et al.
2007/0235005 A1 10/2007 Lewis
2008/0000149 A1 1/2008 Aradi
2008/0041327 A1 2/2008 Lewis et al.
2008/0066699 A1 3/2008 Michelini et al.
2008/0098969 A1 5/2008 Reed et al.
2008/0109151 A1 5/2008 Jaros et al.
2008/0121211 A1 5/2008 Livshiz et al.
2008/0154468 A1 6/2008 Berger et al.
2008/0254926 A1 10/2008 Schuseil et al.
2008/0262698 A1 10/2008 Lahti et al.
2008/0288146 A1 11/2008 Beechie et al.
2009/0007877 A1 1/2009 Raiford
2009/0013667 A1 1/2009 Winstead
2009/0013668 A1 1/2009 Winstead
2009/0013669 A1 1/2009 Winstead
2009/0013969 A1 1/2009 Winstead
2009/0018746 A1 1/2009 Miller et al.
2009/0030594 A1 1/2009 You et al.
2009/0042458 A1 2/2009 Kinoshita
2009/0042463 A1 2/2009 Kinoshita
2009/0118914 A1* 5/2009 Schwenke ..... B60K 6/445 701/51
2009/0118965 A1 5/2009 Livshiz et al.
2009/0118968 A1 5/2009 Livshiz et al.
2009/0118975 A1 5/2009 Murakami et al.
2009/0118986 A1 5/2009 Kita
2009/0177371 A1 7/2009 Reinke
2009/0204312 A1 8/2009 Moriya
2009/0229562 A1 9/2009 Ramappan et al.
2009/0241872 A1 10/2009 Wang et al.
2009/0248277 A1 10/2009 Shinagawa et al.
2009/0248278 A1 10/2009 Nakasaka
2009/0292435 A1 11/2009 Costin et al.
2010/0006065 A1* 1/2010 Tripathi ..... F02D 41/0087 123/350
2010/0010724 A1* 1/2010 Tripathi ..... F02D 41/0087 701/103
2010/0012072 A1 1/2010 Leone et al.
2010/0030447 A1 2/2010 Smyth et al.
2010/0036571 A1 2/2010 Han et al.
2010/0042308 A1 2/2010 Kobayashi et al.
2010/0050993 A1 3/2010 Zhao et al.
2010/0057283 A1 3/2010 Worthing et al.
2010/0059004 A1 3/2010 Gill
2010/0100299 A1* 4/2010 Tripathi ..... F02D 41/0087 701/102
2010/0107630 A1 5/2010 Hamama et al.
2010/0192925 A1 8/2010 Sadakane
2010/0211299 A1 8/2010 Lewis et al.
2010/0222989 A1 9/2010 Nishimura
2010/0282202 A1 11/2010 Luken
2010/0318275 A1 12/2010 Borchsenius et al.
2011/0005496 A1 1/2011 Hiraya et al.
2011/0030657 A1* 2/2011 Tripathi ..... F02D 17/02 123/481
2011/0048372 A1 3/2011 Dibble et al.
2011/0088661 A1 4/2011 Sczomak et al.
2011/0094475 A1 4/2011 Riegel et al.
2011/0107986 A1 5/2011 Winstead
2011/0118955 A1 5/2011 Livshiz et al.
2011/0144883 A1 6/2011 Rollinger et al.
2011/0178693 A1 7/2011 Chang et al.
2011/0208405 A1* 8/2011 Tripathi ..... F02D 17/02 701/102
2011/0213526 A1 9/2011 Giles et al.
2011/0213540 A1* 9/2011 Tripathi ..... F02D 37/02 701/102
2011/0213541 A1 9/2011 Tripathi et al.
2011/0251773 A1 10/2011 Sahandiesfanjani et al.
2011/0264342 A1 10/2011 Baur et al.
2011/0265454 A1 11/2011 Smith et al.
2011/0265771 A1 11/2011 Banker et al.
2011/0295483 A1 12/2011 Ma et al.
2011/0313643 A1 12/2011 Lucatello et al.
2012/0029787 A1 2/2012 Whitney et al.
2012/0055444 A1 3/2012 Tobergte et al.
2012/0103312 A1 5/2012 Sasai et al.
2012/0109495 A1 5/2012 Tripathi et al.
2012/0116647 A1 5/2012 Pochner et al.
2012/0143471 A1 6/2012 Tripathi et al.
2012/0180759 A1 7/2012 Whitney et al.
2012/0221217 A1 8/2012 Sujan et al.
2012/0285161 A1 11/2012 Kerns et al.
2013/0092127 A1 4/2013 Pirjaberi et al.
2013/0092128 A1* 4/2013 Pirjaberi ..... F02D 41/0087 123/406.23
2013/0184949 A1 7/2013 Saito et al.
2013/0289853 A1 10/2013 Serrano
2014/0041625 A1 2/2014 Pirjaberi et al.
2014/0041641 A1 2/2014 Carlson et al.
2014/0053802 A1 2/2014 Rayl
2014/0053803 A1 2/2014 Rayl
2014/0053804 A1 2/2014 Rayl et al.
2014/0053805 A1 2/2014 Brennan et al.
2014/0069178 A1 3/2014 Beikmann
2014/0069374 A1 3/2014 Matthews
2014/0069375 A1 3/2014 Matthews et al.
2014/0069376 A1 3/2014 Matthews et al.

(56) References Cited

U.S. PATENT DOCUMENTS

| | | | |
|---|---|---|---|
| 2014/0069377 | A1 | 3/2014 | Brennan et al. |
| 2014/0069378 | A1 | 3/2014 | Burleigh et al. |
| 2014/0069379 | A1 | 3/2014 | Beikmann |
| 2014/0069381 | A1 | 3/2014 | Beikmann |
| 2014/0090623 | A1 | 4/2014 | Beikmann |
| 2014/0090624 | A1 | 4/2014 | Verner |
| 2014/0102411 | A1 | 4/2014 | Brennan |
| 2014/0190448 | A1 | 7/2014 | Brennan et al. |
| 2014/0194247 | A1 | 7/2014 | Burtch |
| 2014/0207359 | A1 | 7/2014 | Phillips |
| 2015/0240671 | A1 | 8/2015 | Nakamura |
| 2015/0260112 | A1 | 9/2015 | Liu et al. |
| 2015/0260117 | A1 | 9/2015 | Shost et al. |
| 2015/0354470 | A1 | 12/2015 | Li et al. |
| 2015/0361907 | A1 | 12/2015 | Hayman et al. |

FOREIGN PATENT DOCUMENTS

| | | | |
|---|---|---|---|
| CN | 101220780 | A | 7/2008 |
| CN | 101353992 | A | 1/2009 |
| CN | 101476507 | A | 7/2009 |
| CN | 101586504 | A | 11/2009 |
| CN | 102454493 | A | 5/2012 |
| EP | 1489595 | A2 | 12/2004 |
| JP | 2010223019 | A | 10/2010 |
| JP | 2011149352 | A | 8/2011 |

OTHER PUBLICATIONS

U.S. Appl. No. 13/798,518, Beikmann, filed Mar. 13, 2013.
U.S. Appl. No. 13/798,536, Matthews et al., filed Mar. 13, 2013.
U.S. Appl. No. 13/798,540, Brennan et al., filed Mar. 13, 2013.
U.S. Appl. No. 13/798,574, Verner, filed Mar. 13, 2013.
U.S. Appl. No. 13/798,586, Rayl et al., filed Mar. 13, 2013.
U.S. Appl. No. 13/798,590, Brennan et al., filed Mar. 13, 2013.
U.S. Appl. No. 13/798,624, Brennan et al., filed Mar. 13, 2013.
U.S. Appl. No. 13/798,701, Burleigh et al., filed Mar. 13, 2013.
U.S. Appl. No. 13/798,737, Beikmann, filed Mar. 13, 2013.
U.S. Appl. No. 13/798,775, Phillips, filed Mar. 13, 2013.
U.S. Appl. No. 13/799,116, Brennan, filed Mar. 13, 2013.
U.S. Appl. No. 13/798,129, Beikmann, filed Mar. 13, 2013.
U.S. Appl. No. 13/799,181, Beikmann, filed Mar. 13, 2013.
U.S. Appl. No. 14/211,389, Mar. 14, 2014, Liu et al.
U.S. Appl. No. 14/300,469, Jun. 10, 2014, Li et al.
U.S. Appl. No. 14/310,063, Jun. 20, 2014, Wagh et al.
U.S. Appl. No. 14/449,726, Oct. 1, 2014, Hayman et al.
U.S. Appl. No. 14/548,501, Nov. 20, 2014, Beikmann et al.
U.S. Appl. No. 61/952,737, Mar. 13, 2014, Shost et al.
International Search Report and Written Opinion dated Jun. 17, 2015 corresponding to International Application No. PCT/US2015/019496, 14 pages.
U.S. Appl. No. 14/734,619, Jun. 9, 2015, Matthews.
Glossary of Judicial Claim Constructions in the Electronics, Computer and Business Method Arts. Public Patent Foundation. (2010).

* cited by examiner

SYSTEM AND METHOD FOR RANDOMLY ADJUSTING A FIRING FREQUENCY OF AN ENGINE TO REDUCE VIBRATION WHEN CYLINDERS OF THE ENGINE ARE DEACTIVATED

CROSS-REFERENCE TO RELATED APPLICATIONS

This application claims the benefit of U.S. Provisional application Ser. No. 61/749,510, filed on Jan. 7, 2013. The disclosure of the above application is incorporated herein by reference in its entirety.

This application is related to U.S. patent application Ser. No. 13/798,451 filed on Mar. 13, 2013, Ser. No. 13/798,351 filed on Mar. 13, 2013, Ser. No. 13/798,586 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013, Ser. No. 13/798,737 filed on Mar. 13, 2013, Ser. No. 13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, and Ser. No. 13/798,400 filed on Mar. 13, 2013. The entire disclosures of the above applications are incorporated herein by reference.

FIELD

The present disclosure relates to systems and methods for randomly adjusting a firing frequency of an engine to reduce vibration when cylinders of the engine are deactivated.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Under some circumstances, one or more cylinders of an engine may be deactivated to decrease fuel consumption. For example, one or more cylinders may be deactivated when the engine can produce a requested amount of torque while the cylinder(s) are deactivated. Deactivation of a cylinder may include disabling opening of intake and exhaust valves of the cylinder and disabling spark and fueling of the cylinder.

SUMMARY

A system according to the principles of the present invention includes a firing fraction module, an offset generation module, and a firing fraction module. The firing fraction module determines a firing fraction based on a driver torque request. The offset generation module randomly generates an offset. The firing control module adds the firing fraction to a running total each time that a crankshaft of an engine rotates through a predetermined angle, adds the offset to the running total, and executes a firing event in a cylinder of the engine when the running total is greater than or equal to a predetermined value.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
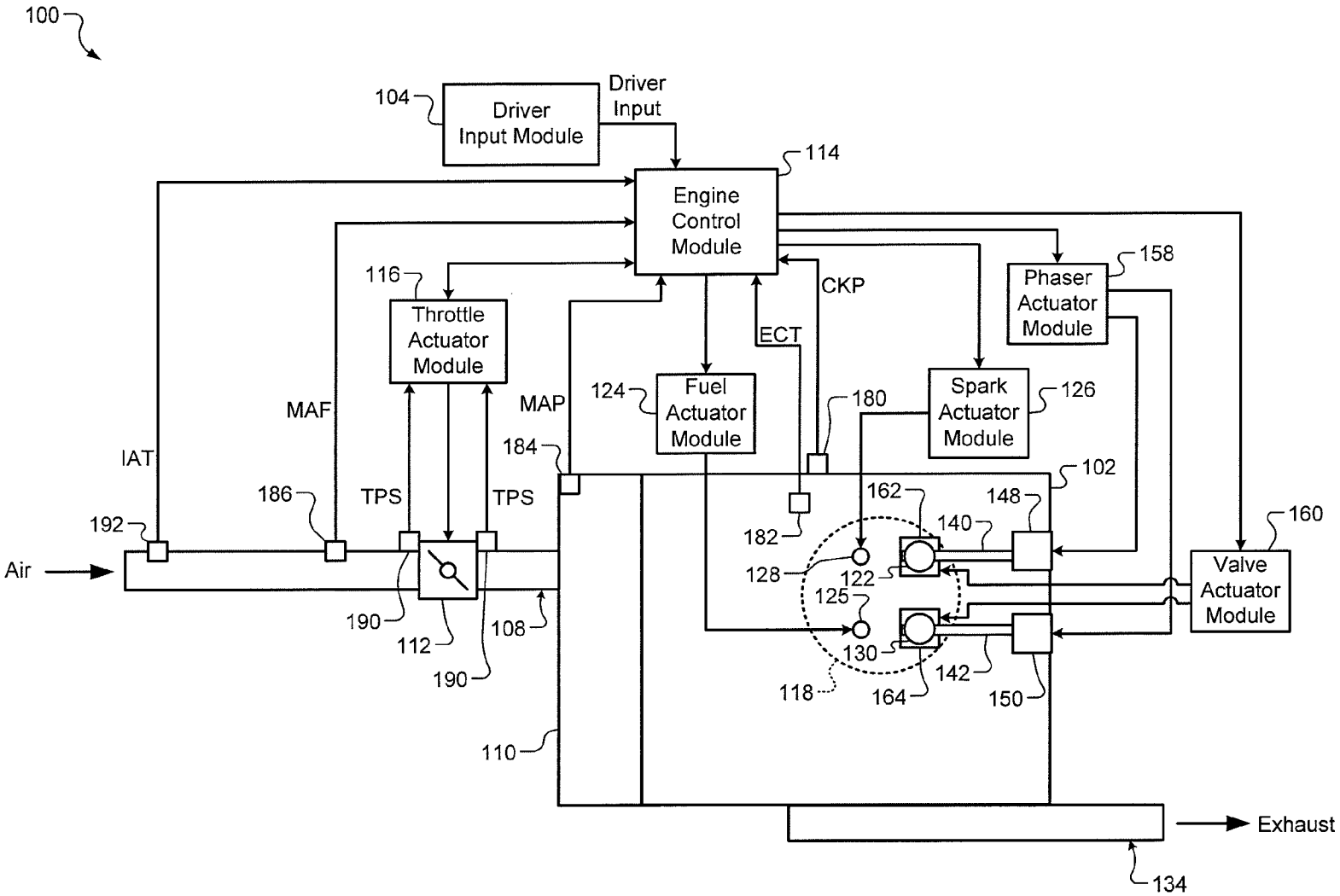
FIG. 1 is a functional block diagram of an example engine system according to the principles of the present disclosure.

A firing frequency of an engine may be adjusted to deactivate cylinders of an engine while satisfying a driver torque request. In one example, the firing frequency is adjusted using a firing fraction. A firing fraction is a ratio of a driver torque request to a maximum torque output of an engine when each cylinder in the engine is active. The firing fraction is added to a running total after each cylinder event in a firing order of the engine. A cylinder event refers to a crank angle increment in which spark is generated in a cylinder when the cylinder is active. When the running total is greater than or equal to a predetermined value (e.g., one), a firing event is executed in the next cylinder of the firing order and the predetermined value is subtracted from the running total.

In one example, an eight-cylinder engine may have a firing fraction of 0.5. Thus, if the running total is initially zero, the running total is equal to 0.5 after one cylinder event and a firing event is not executed. After two cylinder events, the running total is equal to one and a firing event is executed. The running total is then decreased by one, and incrementing the running total by the firing fraction continues in this manner such that a firing event is executed in every other cylinder of the engine.

Adjusting a firing frequency in the manner described above may yield a firing frequency that excites a natural resonance of a vehicle structure between powertrain mounts and driver interface components such as a seat, a steering wheel, and pedals. Noise and vibration at the driver interface components may be represented in the form of a spectral density generating using, for example, a fast Fourier transform. Exciting the natural resonances of the vehicle structure causes spikes in the spectral density, which may cause a driver to perceive an increase in the noise and vibration of a vehicle.

A control system and method according to the present disclosure randomly adjusts a firing frequency of an engine to reduce noise and vibration during cylinder deactivation. The firing fraction is added to the running total after each cylinder event in a firing order of the engine, and a firing event is executed in the next cylinder of the firing order when the running total is greater than or equal to a predetermined value. The firing frequency is randomly adjusted by randomly generating an offset and adding the offset to the running total before comparing the running total to the predetermined value. The offset may be selected from a range of values having a mean value of zero. Thus, adding the offset to the running total may pull ahead or delay the firing event.

Randomly adjusting the firing frequency of an engine yields noise and vibration having a relatively flat frequency distribution (e.g., white noise), which reduces the amount of noise and vibration that is perceived by a driver. In addition, randomly adjusting the firing frequency in the manner described above provides the ability to quickly respond to a change in a driver torque request. For example, when a driver completely depresses an accelerator pedal, the firing fraction may be increased to one such that a firing event is executed in the next cylinder of a firing order of the engine.

Referring now to FIG. 1, an engine system 100 includes an engine 102 that combusts an air/fuel mixture to produce drive torque for a vehicle. The amount of drive torque produced by the engine 102 is based on driver input from a driver input module 104. Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. For illustration purposes, a single representative cylinder 118 is shown. However, the engine 102 may include multiple cylinders. For example, the engine 102 may include 2, 3, 4, 5, 6, 8, 10, and/or 12 cylinders. The ECM 114 may deactivate one or more of the cylinders, which may improve fuel economy under certain engine operating conditions.

The engine 102 may operate using a four-stroke cycle. The four strokes include an intake stroke, a compression stroke, a combustion stroke, and an exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates a fuel injector 125 to control the amount of fuel provided to the cylinder to achieve a desired air/fuel ratio. The fuel injector 125 may inject fuel directly into the cylinder 118 or into a mixing chamber associated with the cylinder 118. The fuel actuator module 124 may halt fuel injection into cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114. The spark ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. A firing event causes combustion in a cylinder when an air/fuel mixture is provided to the cylinder (e.g., when the cylinder is active). The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. As the combustion of the air/fuel mixture drives the piston down, the piston moves from TDC to its bottom-most position, referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. The ECM 114 may disable opening of the intake and exhaust valves 122, 130 of cylinders that are deactivated. A phaser actuator module 158 may control the intake cam phaser 148 and the exhaust cam phaser 150 based on signals from the ECM 114. When implemented, variable valve lift (not shown) may also be controlled by the phaser actuator module 158.

The ECM 114 may deactivate the cylinder 118 by instructing a valve actuator module 160 to deactivate opening of the intake valve 122 and/or the exhaust valve 130. The valve actuator module 160 controls an intake valve actuator 162 that opens and closes the intake valve 122. The valve actuator module 160 controls an exhaust valve actuator 164 that opens and closes the exhaust valve 130. In one example, the valve actuators 162, 164 include solenoids that deactivate opening of the valves 122, 130 by decoupling cam followers from the camshafts 140, 142. In another example, the valve actuators 162, 164 are electromagnetic or electro-hydraulic actuators that control the lift, timing, and duration of the valves 122, 130 independent from the camshafts 140, 142. In this example, the camshafts 140, 142, the intake and exhaust cam phasers 148, 150, and the phaser actuator module 158 may be omitted.

The position of the crankshaft may be measured using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 adjusts a firing frequency of the engine 102 to deactivate cylinders while satisfying a driver torque request. The ECM 114 adds a firing fraction to a running total after each cylinder event in a firing order of the engine 102. A firing fraction is a ratio of a driver torque request to a maximum torque output of the engine 102 when all of the cylinders in the engine 102 are firing. A cylinder event refers to a crank angle increment in which spark is generated in a cylinder when the cylinder is active. The ECM 114 executes a firing event in the next cylinder of the firing order when the running total is greater than or equal to a predetermined value (e.g., one). The ECM 114 then subtracts the predetermined value from the running total.

The ECM 114 randomly adjusts the firing frequency of the engine 102 to reduce noise and vibration during cylinder deactivation. The ECM 114 accomplishes this by randomly generating an offset and adding the offset to the running total before determining whether the running total is greater than or equal to the predetermined value. The offset may be selected from a range of values having a mean value of zero. Thus, adding the offset to the running total may pull ahead or delay the firing event.

Figure 2:
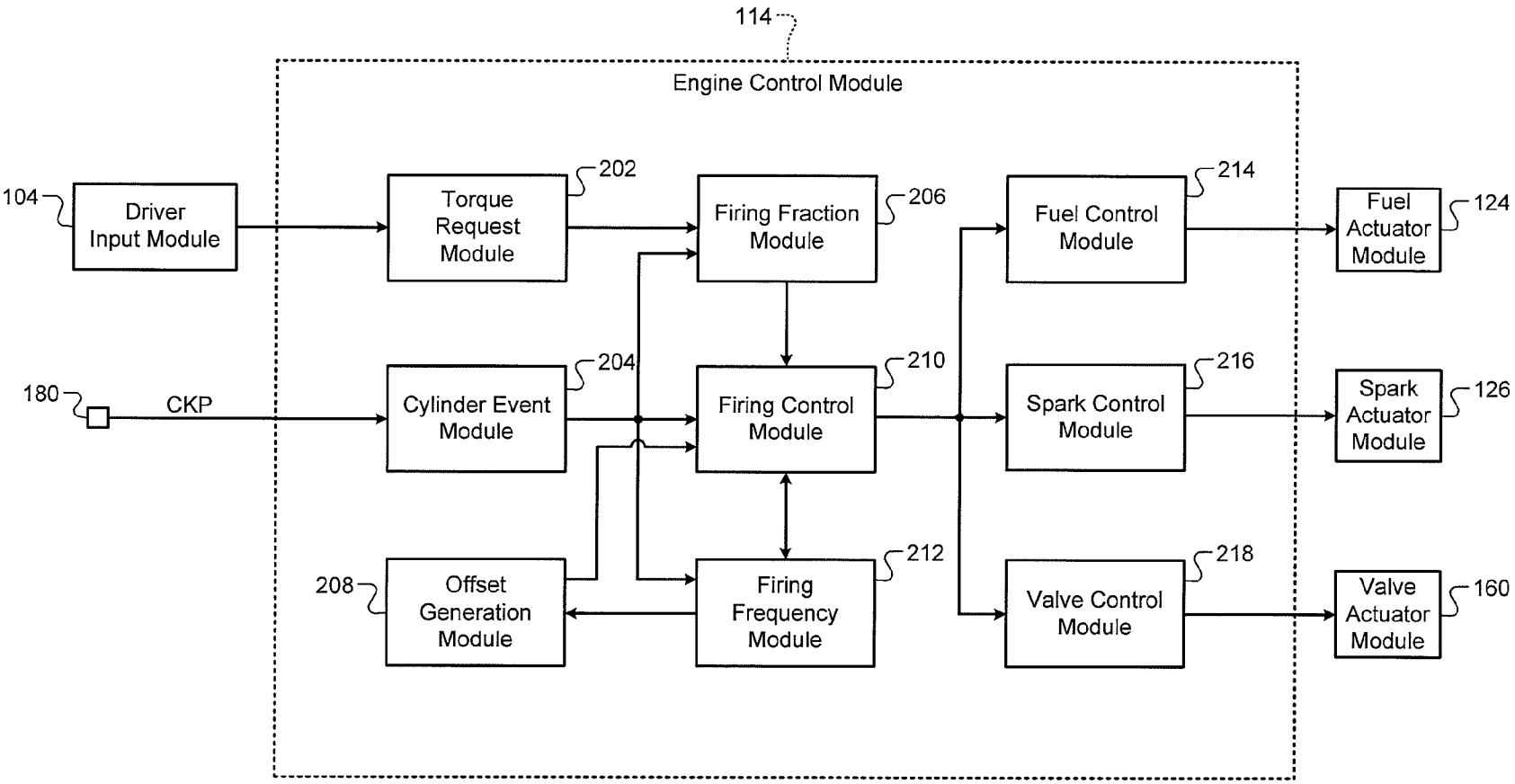
FIG. 2 is a functional block diagram of an example control system according to the principles of the present disclosure.

Referring to FIG. 2, an example implementation of the ECM 114 includes a torque request module 202, a cylinder event module 204, a firing fraction module 206, an offset generation module 208, and a firing control module 210. The torque request module 202 determines a driver torque request based on the driver input from the driver input module 104. The driver input may be based on a position of an accelerator pedal. The driver input may also be based on input from a cruise control system, which may be an adaptive cruise control system that varies vehicle speed to maintain a predetermined following distance. The torque request module 202 may store one or more mappings of accelerator pedal position to desired torque, and may determine the driver torque request based on a selected one of the mappings. The torque request module 202 outputs the driver torque request.

The cylinder event module 204 determines when a cylinder event is complete based on input received from the CKP sensor 180. The cylinder event module 204 may determine that a cylinder event is complete when the crankshaft rotates by a predetermined amount. For example, for an eight-cylinder engine that executes four firing events every 360 degrees of crankshaft rotation when all cylinders are active, each cylinder event may correspond to 90 degrees of crankshaft rotation. The cylinder event module 204 outputs a signal indicating when a cylinder event is complete.

The firing fraction module 206 determines a firing fraction based on the driver torque request and the maximum torque output of the engine 102 when all of the cylinders in the engine 102 are firing. The firing fraction module 206 divides the driver torque request by the maximum torque output of the engine 102 to obtain the firing fraction. The firing fraction module 206 may adjust the firing fraction after each cylinder event. The firing fraction module 206 outputs the firing fraction.

The offset generation module 208 randomly generates an offset. The offset generation module 208 may select the offset from a range of values having a mean value of zero. In one example, offset generation module 208 may select the offset from a range of values between a negative value of the firing fraction and a positive value of the firing fraction. The offset generation module 208 outputs the offset.

The firing control module 210 adds the firing fraction to a running total after each cylinder event and executes a firing event in the next cylinder of the firing order when the running total is greater than or equal to one. The firing control module 210 may add the offset to the running total before determining whether the running total is greater than or equal to one. Since the offset may be a positive or a negative, adding the offset to the running total may pull ahead or delay the firing event. The firing control module 210 subtracts one from the running total after executing a firing event.

A firing frequency module 212 determines a firing frequency of the engine 102. The firing frequency module 212 may determine the firing frequency based on input received from the CKP sensor 180 and the firing control module 210. For example, the firing frequency module 212 may divide the number of firing events by a corresponding amount of crankshaft rotation to obtain the firing frequency. The firing frequency module 212 outputs the firing frequency.

The offset generation module 208 may adjust the range from which the offset is selected based on the firing frequency. For example, the offset generation module 208 may increase the range as the firing frequency approaches resonant frequency of a vehicle structure between powertrain mounts and driver interface components such as a seat, a steering wheel, and pedals. The excitation frequencies may be predetermined using, for example, modal analysis and/or physical testing.

In one example, the offset generation module 208 may increase the range from zero to a range having a negative lower limit, a positive upper limit, and a mean value of zero. The negative lower limit may be equal to a negative value of the firing fraction, or a fraction thereof, and the positive upper limit may be equal to a positive value of the firing fraction, or a fraction thereof. In various implementations, the offset generation module 208 may set the offset equal to a sinusoidal signal that varies between the upper and lower limits with respect to time or crankshaft rotation.

In addition to or instead of adjusting the range from which the offset is selected based on the firing frequency, the firing control module 210 may determine whether to add the offset to the running total based on the firing frequency. For example, the firing control module 210 may add the offset to the running total when the firing frequency is within a predetermined range of a resonant frequency of the vehicle structure. Conversely, the firing control module 210 may not add the offset to the running total when the firing frequency is outside of the predetermined range.

The fuel control module 214 instructs the fuel actuator module 124 to provide fuel to a cylinder of the engine 102 to execute a firing event in the cylinder. The spark control module 216 instructs the spark actuator module 126 to generate spark in a cylinder of the engine 102 to execute a firing event in the cylinder. The valve control module 218 instructs the valve actuator module 160 to open intake and exhaust valves of a cylinder to execute a firing event in the cylinder.

Figure 3:
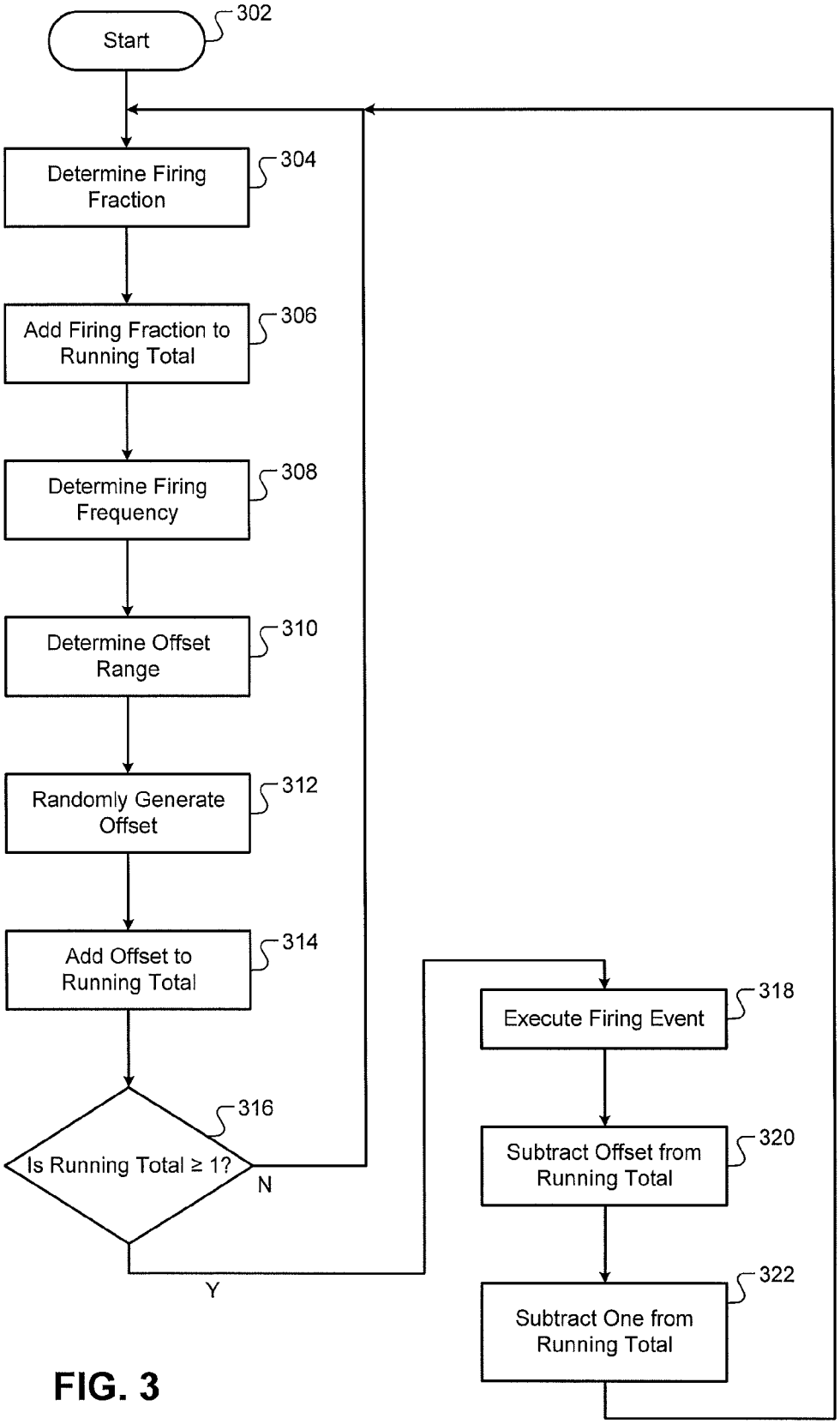
FIG. 3 is a flowchart illustrating an example control method according to the principles of the present disclosure.

Referring now to FIG. 3, a method for randomly adjusting a firing frequency of an engine to reduce vibration when cylinders of the engine are deactivated begins at 302. At 304, the method determines a firing fraction based on a driver torque request and a maximum torque output of the engine when all of the cylinders of the engine are firing. The method divides the driver torque request by the maximum torque output to obtain the firing fraction. The method may determine the driver torque request based on an accelerator pedal position and/or a cruise control setting.

At 306, the method adds the firing fraction to a running total. The running total may be set to zero when the engine is initially started. At 308, the method determines a firing frequency of the engine. The method may determine the firing frequency based on the amount of crankshaft rotation and/or the amount of time between firing events.

At 310, the method determines an offset range. The method may adjust the offset range based on the firing frequency. For example, the method may increase the offset range as the firing frequency approaches a resonant frequency of a vehicle structure between powertrain mounts and driver interface components such as a seat, a steering wheel, and pedals. The excitation frequencies may be predetermined using, for example, modal analysis and/or physical testing. In one example, the method may increase the offset range from zero to a range having a negative lower limit, a positive upper limit, and a mean value of zero. The negative lower limit may be equal to a negative value of the firing fraction, or a fraction thereof, and the positive upper limit may be equal to a positive value of the firing fraction, or a fraction thereof. In various implementations, the method may set the offset equal to a sinusoidal signal that varies between the upper and lower limits with respect to time or crankshaft rotation.

At 312, the method randomly generates an offset. For example, the method may randomly select an offset from the offset range. At 314, the method adds the offset to the running total. In various implementations, the method may add the offset to the running total when the firing frequency is within a predetermining range of a resonant frequency of the vehicle structure. Conversely, the method may not add the offset to the running total when the firing frequency is outside of the predetermining range.

At 316, the method determines whether the running total is greater than or equal to one. If the running total is greater than or equal to one, the method continues at 318. Otherwise, the method continues at 304. At 318, the method executes a firing event in the next cylinder of a firing order of the engine.

At 320, the method subtracts the offset from the running total. In this regard, the method may only temporarily add the offset to the running total at 314, and then subtract the offset from the running total after the determination is made at 316. Subtracting the offset from the running total may minimize or eliminate the effect of the method on the average firing fraction or firing frequency over a sufficiently long sequence of cylinder events (e.g., over one or more complete rotations of a crankshaft). In turn, the driver may not perceive a change in torque output due to a change in the average firing fraction or firing frequency.

In various implementations, the method may not subtract the offset from the running total (e.g., 320 may be omitted). In these implementations, the mean of the offsets added to the running total may be zero. Thus, the method may have no effect on the average firing fraction or firing frequency over a sufficiently long sequence of cylinder events.

At 322, the method subtracts one from the running total and continues at 304. The method may complete one iteration of the control loop of FIG. 3 for each cylinder event (e.g., each time that a crankshaft rotates through a predetermined angle). Thus, the method may evaluate and/or adjust the firing fraction on a cylinder-by-cylinder basis.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a firing fraction module that determines a firing fraction based on a driver torque request;

an offset generation module that randomly generates an offset; and a firing control module that:

sums the firing fraction and a running total each time that a crankshaft of an engine rotates through a predetermined angle;

sums the offset and the running total; and controls an actuator of the engine to execute a firing event in a cylinder of the engine when the running total is greater than or equal to a predetermined value.

2. The system of claim 1 wherein the firing fraction module sets the firing fraction equal to a ratio of the driver torque request to a torque output of the engine when each cylinder in the engine is active.

3. The system of claim 1 wherein the firing control module subtracts the offset from the running total after determining whether the running total is greater than or equal to the predetermined value.

4. The system of claim 1 wherein the firing control module subtracts the predetermined value from the running total after executing the firing event.

5. The system of claim 1 further comprising a firing frequency module that determines a firing frequency of the engine based on an amount of crankshaft rotation between firing events.

6. The system of claim 1 wherein the firing control module adds the offset to the running total each time that the crankshaft rotates through the predetermined angle.

7. The system of claim 6 wherein the firing control module adds the offset to the running total when a firing frequency of the engine is within a predetermined range of a resonant frequency of a vehicle structure.

8. The system of claim 1 wherein the offset generation module randomly selects the offset from an offset range having a mean value of zero.

9. The system of claim 8 wherein the offset generation module increases the offset range when a difference between a firing frequency of the engine and a resonant frequency of a vehicle structure decreases.

10. The system of claim 8 wherein the offset generation module increases the offset range from zero to a non-zero value when a firing frequency of the engine is within a predetermined range of a resonant frequency of a vehicle structure.

11. A method comprising:

determining a firing fraction based on a driver torque request;

randomly generating an offset;

summing the firing fraction and a running total each time that a crankshaft of an engine rotates through a predetermined angle;

summing the offset and the running total; and controlling an actuator of the engine to execute a firing event in a cylinder of the engine when the running total is greater than or equal to a predetermined value.

12. The method of claim 11 further comprising setting the firing fraction equal to a ratio of the driver torque request to a torque output of the engine when each cylinder in the engine is active.

13. The method of claim 11 further comprising subtracting the offset from the running total after determining whether the running total is greater than or equal to the predetermined value.

14. The method of claim 11 further comprising subtracting the predetermined value from the running total after executing the firing event.

15. The method of claim 11 further comprising determining a firing frequency of the engine based on an amount of crankshaft rotation between firing events.

16. The method of claim 11 further comprising adding the offset to the running total each time that the crankshaft rotates through the predetermined angle.

17. The method of claim 16 further comprising adding the offset to the running total when a firing frequency of the engine is within a predetermined range of a resonant frequency of a vehicle structure.

18. The method of claim 11 further comprising randomly selecting the offset from an offset range having a mean value of zero.

19. The method of claim 18 further comprising increasing the offset range when a difference between a firing frequency of the engine and a resonant frequency of a vehicle structure decreases.

20. The method of claim 18 further comprising increasing the offset range from zero to a non-zero value when a firing frequency of the engine is within a predetermined range of a resonant frequency of a vehicle structure.

* * * * *